United States Patent [19]

Willis et al.

[11] Patent Number: 4,842,250

[45] Date of Patent: Jun. 27, 1989

[54] LINE REEVING SYSTEM FOR EARTH DRILLING MACHINE

[75] Inventors: Clyde A. Willis; Keith M. Haney, both of Wichita Falls, Tex.

[73] Assignee: W-N Apache Corporation, Wichita Falls, Tex.

[21] Appl. No.: 92,632

[22] Filed: Sep. 3, 1987

[51] Int. Cl.[4] ..... B66D 1/36; B66D 3/08

[52] U.S. Cl. ..... 254/337; 254/399; 254/400

[58] Field of Search ..... 254/283, 284, 285, 286, 254/334, 335, 336, 337, 338, 326, 327, 394, 398, 399, 400; 166/85, 75.1, 77; 175/85, 52, 161, 203

[56] References Cited

U.S. PATENT DOCUMENTS

| | | | |
|---|---|---|---|
| 25,730 | 2/1965 | Minor . | |
| 484,038 | 10/1892 | Morgan | 254/399 |
| 619,074 | 2/1899 | Deering | 254/290 |
| 1,461,650 | 7/1923 | Falzer et al. | 254/334 |
| 1,910,173 | 5/1933 | Laing et al. | 254/394 |
| 2,351,824 | 6/1944 | Le Tourneau | 254/399 X |
| 2,734,718 | 2/1956 | Minor | 254/399 |
| 2,737,367 | 3/1956 | Woolslayer et al. | 254/400 |
| 2,744,725 | 5/1986 | Woolslayer et al. | 254/400 |
| 2,766,009 | 10/1956 | Wilson | 254/336 |
| 2,954,131 | 9/1960 | Wilkinson . | |
| 2,966,994 | 1/1961 | Wolff | 414/22 |
| 3,658,298 | 4/1972 | Moore et al. | 254/286 |
| 3,936,034 | 2/1976 | Larralde | 254/399 |
| 3,940,112 | 2/1976 | Lea | 254/399 |
| 4,390,162 | 6/1983 | Woolslayer | 254/399 X |
| 4,434,971 | 3/1984 | Cordrey . | |

FOREIGN PATENT DOCUMENTS

| | | | |
|---|---|---|---|
| 1236751 | 3/1967 | Fed. Rep. of Germany | 254/283 |
| 43744 | 11/1966 | German Democratic Rep. | 254/286 |
| 244572 | 11/1984 | United Kingdom . | |

*Primary Examiner*—Joseph J. Hail, III

*Attorney, Agent, or Firm*—Willian Brinks Olds Hofer Gilson & Lione Ltd.

[57] ABSTRACT

An earth drilling machine includes a crown block assembly, a travelling block assembly and a drawworks. The drawworks includes a drum which rotates about a drum axis. The drum axis is oriented at right angles to a fast line plane defined by a fast line sheave included in the crown block assembly. In this way, the fleet angle between the drum and the fast line sheave is kept substantially equal to zero. Various sheave arrangements are described which combine proper selection of sheave pitch diameter, sheave axis angle, and sheave placement to ensure that the fleet angle of all of the sections of line extending between the crown block assembly and the travelling block assembly are reeved with a fleet angle exactly equal to zero. In this way line wear is reduced and the height, weight and windage of the mast are all minimized.

25 Claims, 8 Drawing Sheets

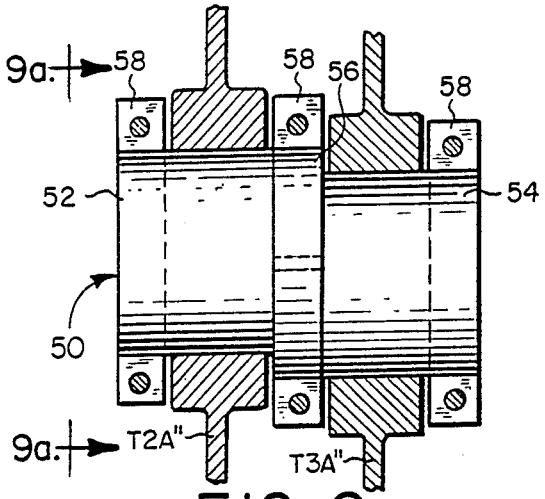
FIG. 9
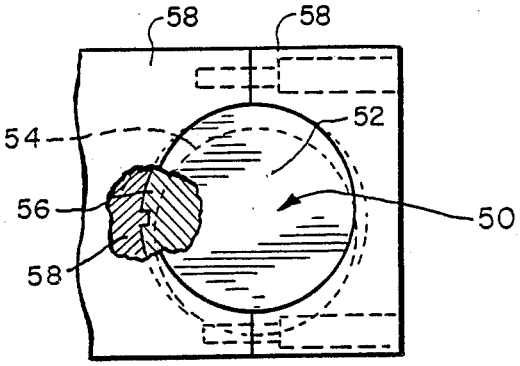
FIG. 9a
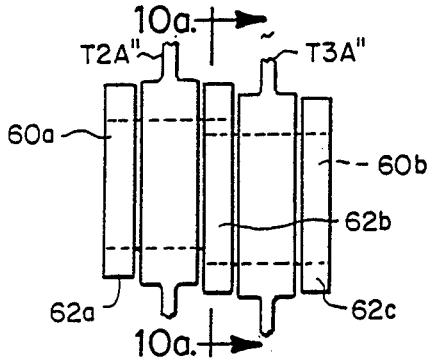
FIG. 10
FIG. 10a
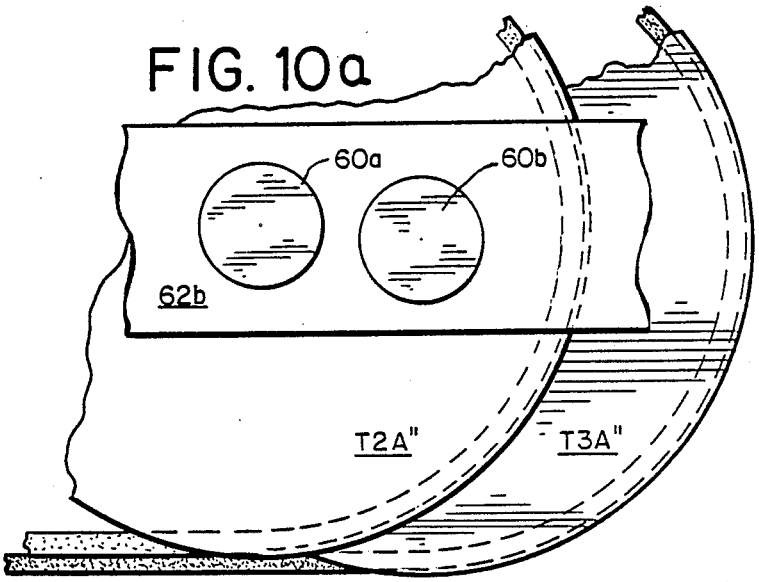
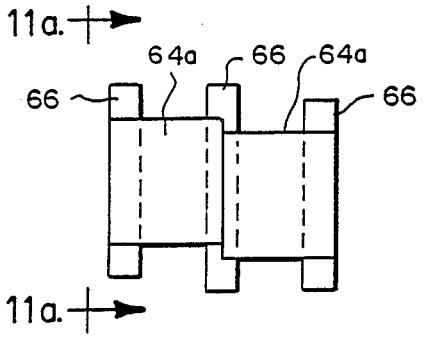
FIG. 11
FIG. 11a
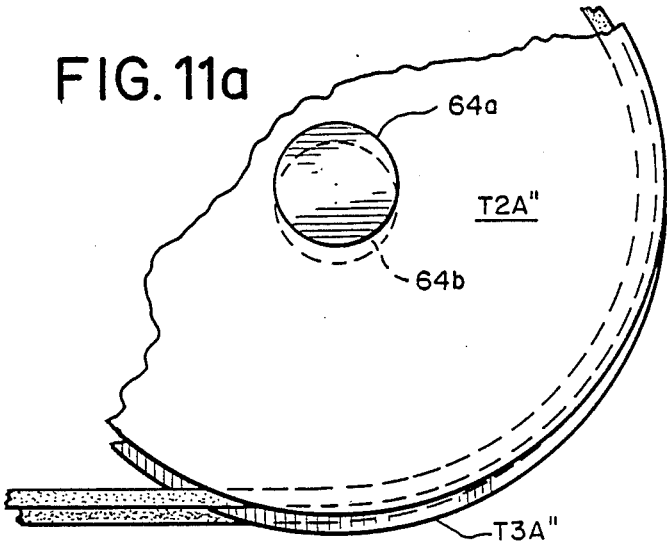

LINE REEVING SYSTEM FOR EARTH DRILLING MACHINEBACKGROUND OF THE INVENTION

The present invention relates to an improved line reeving system for an earth drilling machine, which reduces fleet angles to zero while providing all of the advantages of an open crown block assembly.

Conventional top head drive earth drilling machines include a mast and a top head drive assembly which is guided for movement along the mast. The mast supports at its upper end a crown block assembly, and the top head drive assembly supports a travelling block assembly. Often, a drawworks is mounted at ground level and a line is reeved from the drawworks to the crown block assembly, between the crown block assembly and the travelling block assembly, and then from the crown block assembly to a dead line anchor on the drawworks. Because of the need to reeve the line back and forth between the crown block assembly and the travelling block assembly, the line typically defines a non-zero fleet angle for one or more line sections. In this context, the term "fleet angle" is intended to mean the angle between a length of line and a plane defined by the sheave and oriented perpendicular to the shaft of the sheave.

A non-zero fleet angle brings with it a number of important disadvantages. First, because a non-zero fleet angle will increase in magnitude as the top head drive assembly is brought closer to the crown block assembly, a non-zero fleet angle prevents the top head drive assembly from approaching closely to the crown block assembly. As a practical matter, this means that there is a dead space in the mast, which must be provided to keep the fleet angle within allowable limits, but which cannot be used during normal raising and lowering of the top head drive assembly. Such extra mast length results in unnecessary height and weight for the drilling machine. This disadvantage is particularly important in off shore drilling machines, where the increased window associated with increased length of the mast is particularly troublesome.

Non-zero fleet angles also increase line wear, and this represents another significant disadvantage of prior art systems employing non-zero fleet angles.

It is accordingly an object of this invention to provide an improved reeving system which insures zero fleet angles between the crown block assembly and the travelling block assembly, and which insures substantially zero fleet angles between the crown block assembly and the drawworks.

SUMMARY OF THE INVENTION

According to a first feature of this invention the drawworks assembly comprises a drawworks drum having a drum rotation axis, and the drawworks assembly is mounted adjacent to the mast such that the drum rotation axis is parallel to a fast line plane which passes through a fast line sheave of the crown block assembly. A line is reeved from the drawworks drum to the fast line sheave and then between the crown block assembly and the travelling block assembly of the earth drilling machine. This line remains substantially within the fast line plane as the line passes between the drum and the fast line sheave throughout the complete range of rotation of the drawworks drum, thereby insuring that the fleet angle of the line at the fast line sheave remains substantially equal to zero.

As pointed out in detail below, this orientation of the drawworks drum insures that movement of the line along the length of the drum during drawworks operation does not move the line out of the fast line plane. In fact, the only movement of the line at the drawworks drum which takes the line out of the fast line plane is due to the wrapping of the line in multiple layers on the drawworks drum. In a typical conventional operation, two to five layers of line on the drum are sufficient. Thus, the typical maximum deviation of the line at the drawworks from the fast line plane is one or at most two line diameters.

According to a second feature of this invention an earth drilling machine of the general type described above includes a transfer sheave included in the crown block assembly which serves to transfer the line from one travelling block sheave to a next adjacent travelling block sheave. The transfer sheaves and the travelling block sheaves are mounted to rotate about axes which are canted with respect to one another and the transfer sheaves and the travelling block sheaves define respective pitch diameters which differ from one another by an amount selected to insure that the line defines a zero fleet angle with respect to both the transfer sheaves and the travelling block sheaves.

According to a third aspect of this invention, an earth drilling machine of the general type described above includes first and second pairs of transfer sheaves included in the crown block assembly. Each of these pairs includes first and second transfer sheaves, and the first transfer sheaves each define a pitch diameter smaller than that of the associated second transfer sheave. The transfer sheaves in each pair are mounted to rotate on a common axis, and the line is reeved between the transfer sheaves and the travelling block sheaves. The travelling block sheaves define a pitch diameter which differs from that of the first and second transfer sheave pitch diameters such that the line defines a zero fleet angle with respect to both the transfer sheaves and the travelling block sheaves. As explained below, this feature of the invention maintains a zero fleet angle while allowing both the transfer sheaves to be mounted on a common axis.

According to a fourth feature of this invention, an earth drilling machine of the general type described above is provided with first and second sets of transfer sheaves included in the crown block assembly, and each of these sets comprises at least first and second transfer sheaves mounted to rotate about parallel, laterally offset axis. A line is reeved around the transfer sheaves and the travelling block sheaves and the transfer sheaves are dimensioned and positioned to insure that the line defines a zero fleet angle with respect to both the transfer sheaves and the travelling block sheaves. As pointed out below, the laterally offset axes of the transfer sheaves effectively maintain the relevant fleet angles at the zero. Alternatively, the travelling block sheaves can be mounted on laterally offset axes.

The four features of this invention described above can be used singly, or in various combinations. The invention itself, together with further objects and attendant advantages, will best be understood by reference to the following detailed description, taken in conjunction with the accompanying drawings.

BRIEF DESCRIPTION OF THE DRAWINGS

FIG. 9 is a fragmentary view of an offset shaft suitable for use in the crown block assembly of FIG. 5*a*.

FIG. 9*a* is a sectional view taken along line 9*a*–9*a* of FIG. 9.

FIG. 10 is a fragmentary view of two offset shafts suitable for use in the embodiment of FIG. 5*a*.

FIG. 10*a* is a cross-sectional view taken along line 10*a*–10*a* of FIG. 10.

FIG. 11 is a fragmentary view of abutting shafts suitable for use in the embodiment of FIG. 5*a*.

FIG. 11*a* is a sectional view taken along line 11*a*–11*a* of FIG. 11.

DETAILED DESCRIPTION OF THE PRESENTLY PREFERRED EMBODIMENTS

Figure 1:
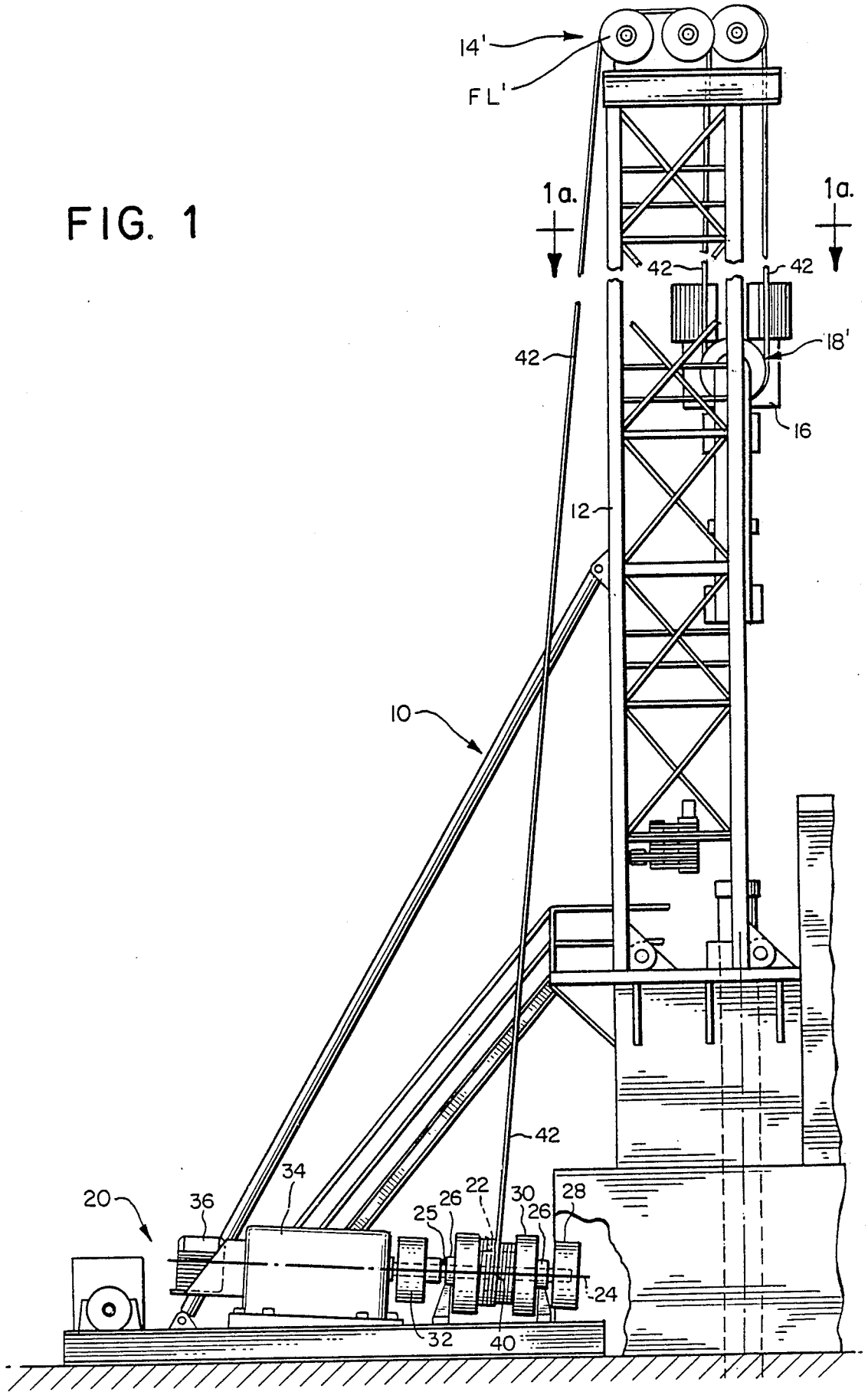
FIG. 1 is a side elevation of portions of a top head drive type of earth drilling machine which incorporates presently preferred embodiments of the present invention.

FIG. 1 shows a partial elevation of an earth drilling machine 10 which incorporates presently preferred embodiments of this invention. This earth drilling machine 10 includes a mast 12 which supports at its upper end a crown block assembly 14'. The mast also supports a top head drive assembly 16 for movement along the mast 12. This top head drive assembly 16 includes a travelling block assembly 18'. In general terms these components of a top head drive type earth drilling machines are conventional.

Figure 2:
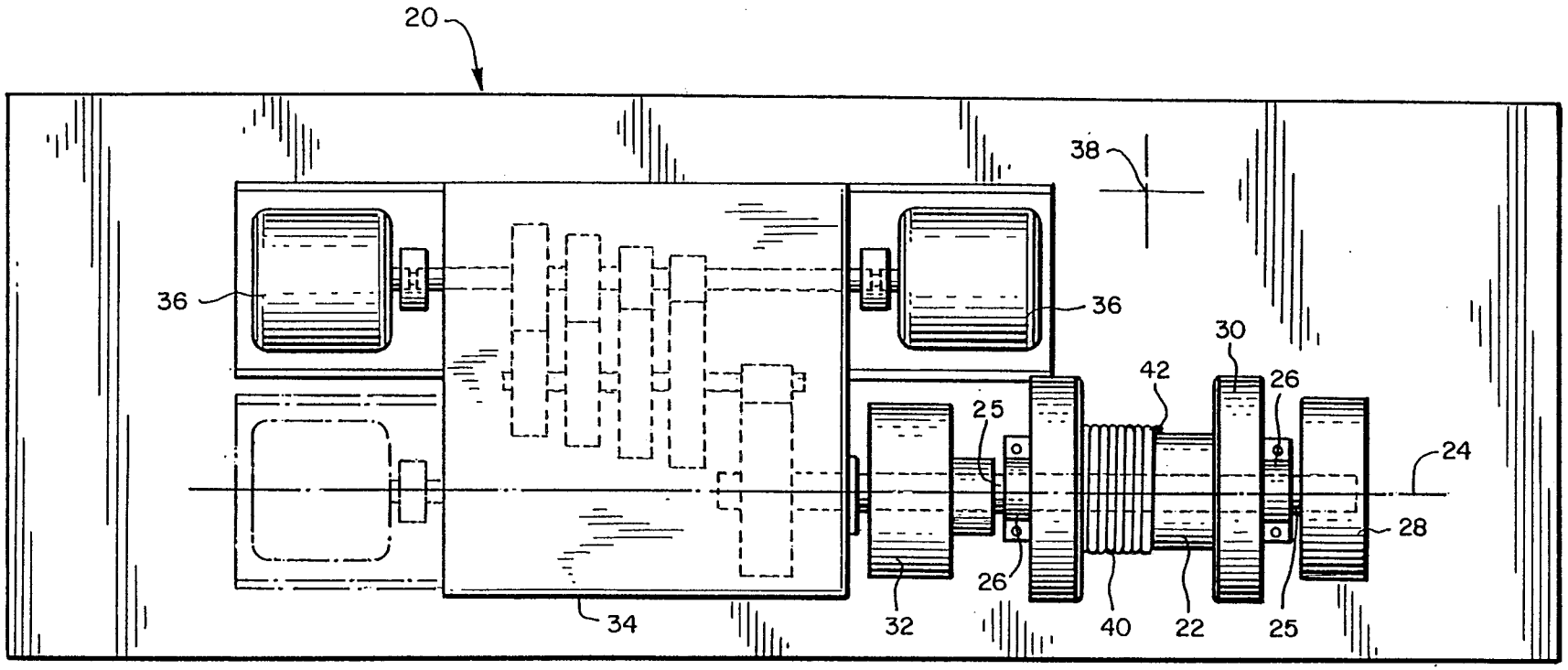
FIG. 2 is a plan view of a drawworks included in the earth drilling machine of FIG. 1.

The earth drilling machine 10 also includes a drawworks assembly 20, and this drawworks assembly 20 includes a rotatable drum 22 which rotates on a shaft 25 about a drum axis 24 (FIGS. 1 and 2). The shaft 25 is supported by shaft bearings 26, and rotation of the drum 22 is braked by an air operated disk brake 28 and a dual band brake 30. The shaft 25 is connected to a transmission 34 by a conventional air operated disc clutch 32. The transmission 34 is in turn powered by a pair of electric motors 36. In this embodiment the transmission 34 is a four-speed double reduction gear box. The drawworks assembly 20 defines a dead line anchor 38, and a line such as a conventional drilling line 42 is wrapped around the drawworks assembly drum 22. The details of construction of the elements of the drawworks assembly 20 described above are well known to those skilled in the art and do not form part of this invention. They will not therefore be described in greater detail here.

Figure 1A:
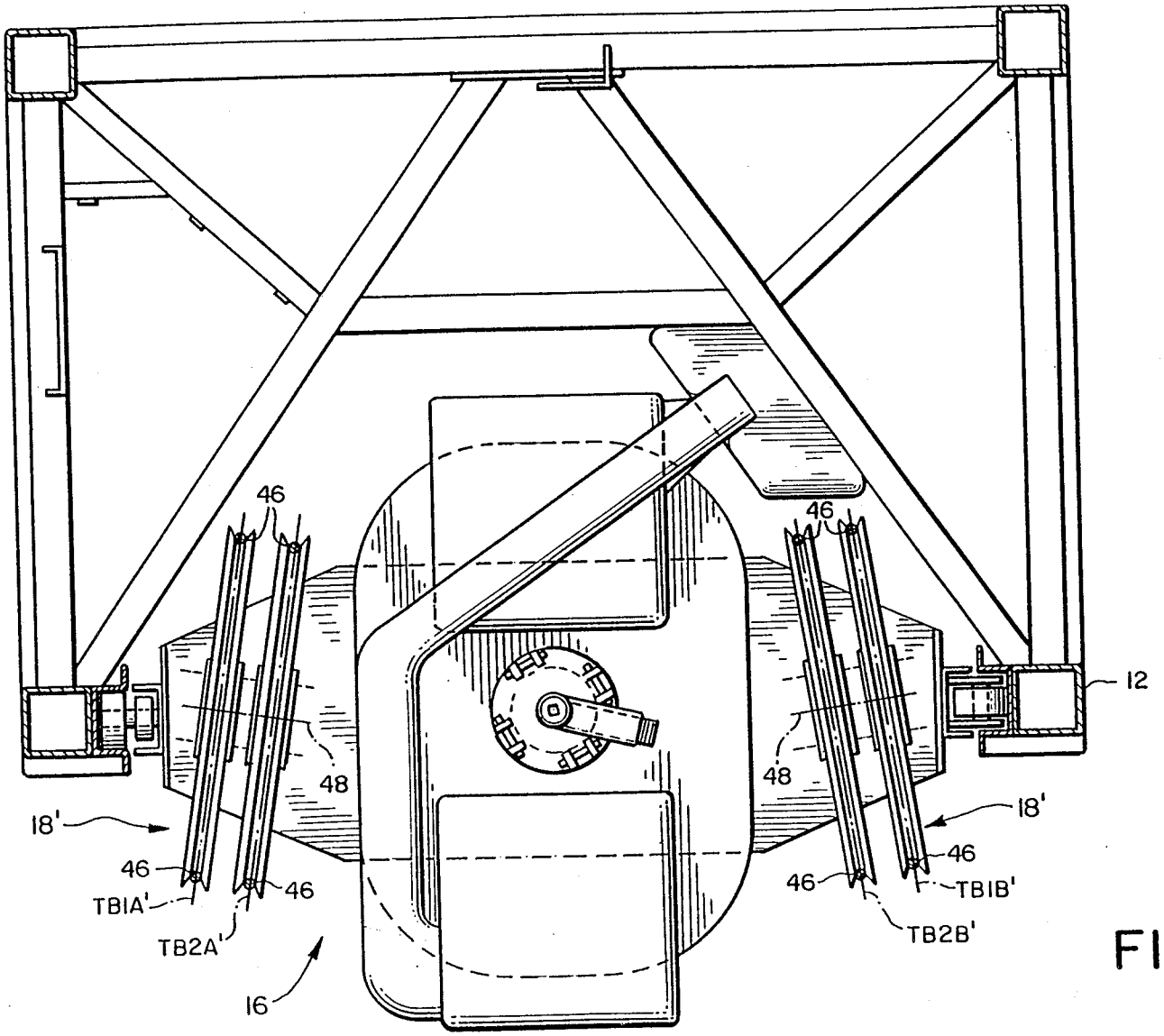
FIG. 1*a* is a cross section taken along line 1*a*–1*a* of FIG. 1.
Figure 4A:
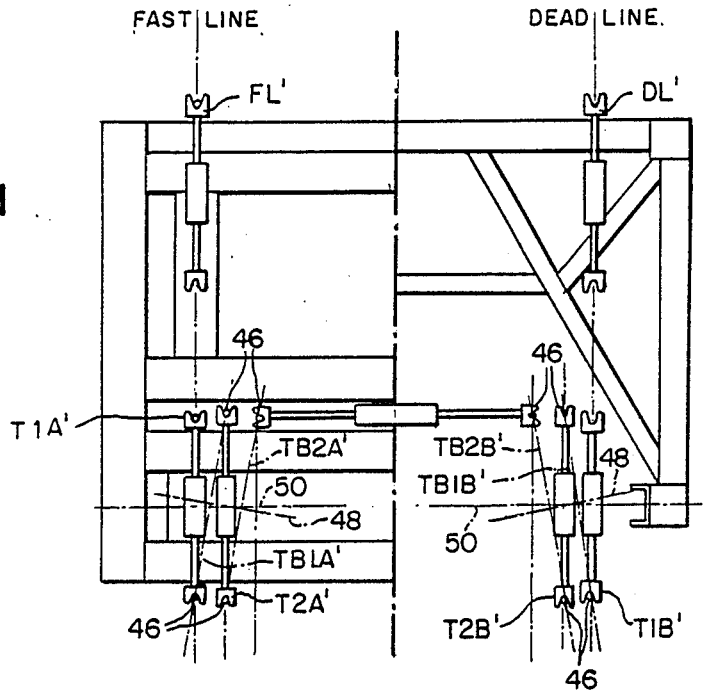
FIGS. 4*a*, *b* and *c* are plan, front elevation, and side elevation views, respectively, of a crown block assembly according to a second preferred embodiment of this invention.
Figure 4B:
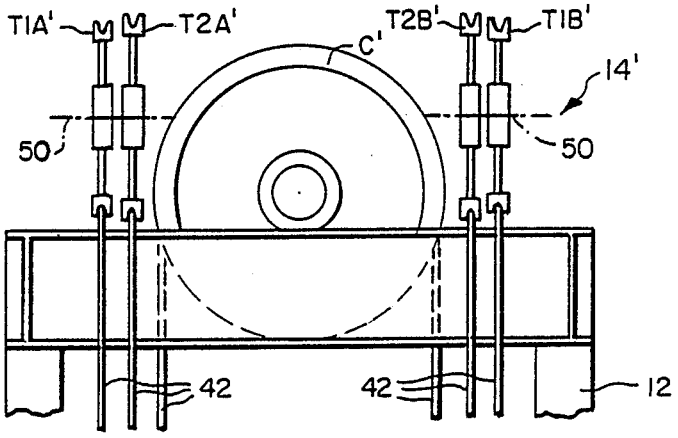
Figure 4C:
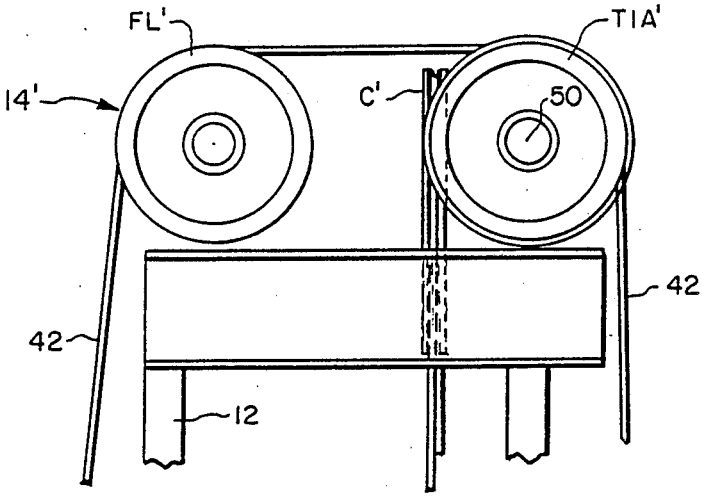

The line 42 is reeved from the the drawworks assembly drum 22 to a fast line sheave FL' included in the crown block assembly 14'. After passing a number of times, in this example 8 times, between the crown block assembly 14' and the travelling block assembly 18', the line 42 is then reeved via a dead line sheave DL' to the dead line anchor 38. FIG. 1*a* shows another view of the travelling block assembly 18', and FIGS. 4*a*–4*c* show various views of the crown block assembly 14'.

The line 42 contacts the drum 22 at a contact point 40 as shown in FIGS. 1 and 2. Rotation of the drum 22 causes this contact point to move along the length of the drum 22, parallel to the drum axis 24.

According to this invention, the drum axis 24 is arranged such that the line 42 extending between the contact point 44 and the fast line sheave FL' remains substantially within a fast line plane that passes through the fast line sheave FL' transverse to the shaft on which the fast line sheave FL' is mounted. For this reason, the fleet angle of the line 42 with respect to the fast line sheave FL' does not vary as the contact point 44 moves along the length of the drum 22. Typically, multiple layers of the line 42 are wound onto the drum 22 as the top head drive assembly 16 is raised in the mast 12. Such layering of the line 42 on the drum 22 causes the contact point 44 to move transversely to the fast line plane. However, no more than three to five layers of line 42 are conventionally required on the drum 22, and if the middle layer is aligned with the fast line plane, then all three of the layers are within one or two line diameters of the fast line plane. This represents an extremely small fleet angle which in most applications will be less than four minutes of arc. Such an extremely small fleet angle is equal to zero for all practical purposes.

In order to minimize line chafing, the axis 24 of the drum 22 is angled with respect to the horizontal by an amount selected to ensure that the plane which contains the drum axis 24 and the contact point 40 is transverse to the fast line plane.

The deadline section of the line 42 extends between the deadline anchor 38 and the deadline sheave DL' and is oriented parallel to the fast line plane described above. In this way loads on the mast 12 are balanced and torque variations associated with movement of the line 42 along the length of the drum 22 are substantially eliminated.

Figure 3A:
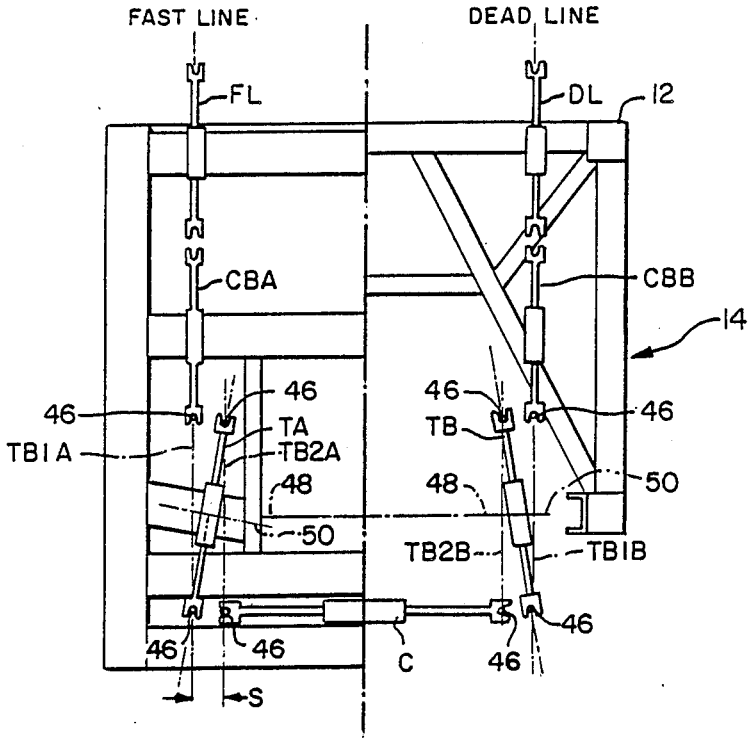
FIGS. 3*a*, *b* and *c* are plan, front elevation, and side elevation views, respectively, of a crown block assembly according to a first preferred embodiment of this invention.
Figure 6:
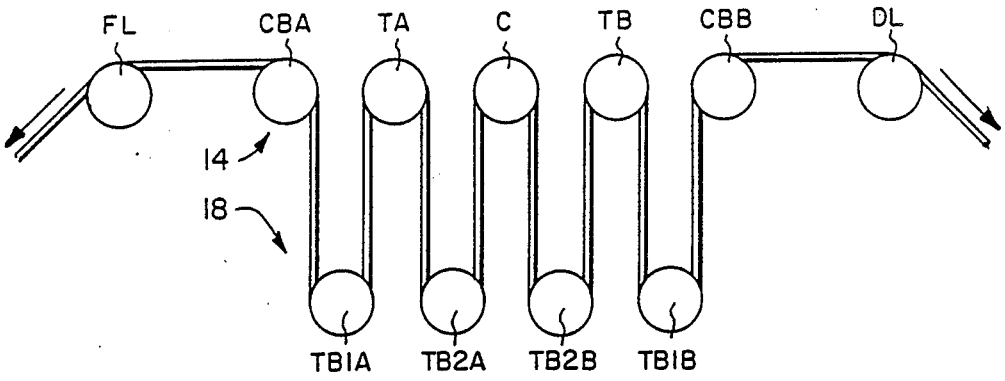
FIGS. 6, 7 and 8, are schematic reeving diagrams of the crown block assemblies of FIGS. 3*a*, 4*a* and 5*a*, respectively.
Figure 7:
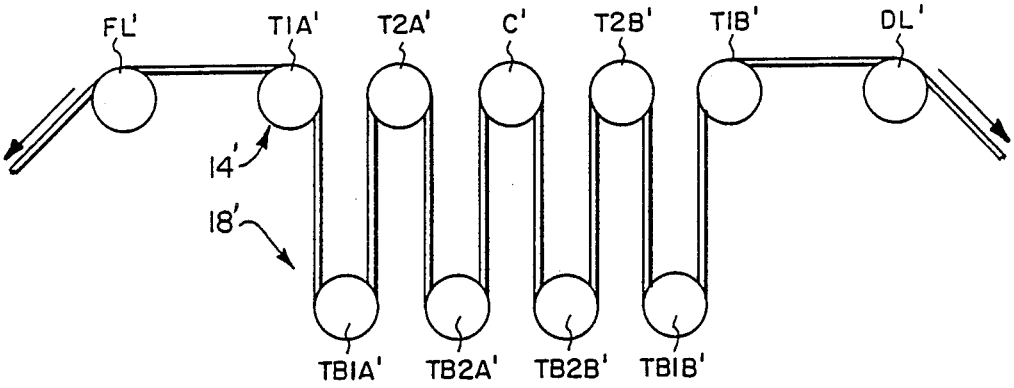

FIGS. 3*a*, *b* and *c* and FIG. 6 relate to a first preferred embodiment of the crown block assembly 14 and the travelling block assembly 18 of this invention. As shown in FIG. 3*a*, the crown block assembly 14 includes a fast line sheave FL, a dead line sheave DL, two crown block sheaves CBA, CBB, two transfer sheaves TA, TB, and a crossover sheave C. The travelling block assembly 18 includes two pairs of travelling block sheaves TB1A, TB2A; TB1B, TB2B. As shown in FIG. 3*a*, these four travelling block sheaves TB1A, TB2A, TB1B, TB2B are all parallel to one another and are all arranged to rotate about a common axis 48. Dashed lines are used in FIG. 3*a* to show the planes of the travelling block sheaves.

The line 42 is reeved as shown in FIG. 6 and the vertically oriented sections of the line 42 are shown by circles 46 in FIG. 3*a*. Thus the circles 46 indicate both the points of contact of the line 42 with the travelling block sheaves and the points of contact of the line 42 with the respective crown block sheaves.

According to this invention, the axes of the transfer sheaves TA, TB are canted with respect to the axis 50 of the travelling block sheaves TB1A, TB2A, TB1B, TB2B. Furthermore, the pitch diameter of the transfer sheaves TA, TB is somewhat larger than the pitch diameters of the travelling block sheaves. By insuring that the transfer sheaves TA, TB are slightly larger in pitch diameter than the travelling block sheaves, it is insured that all eight sections of the line 42 passing between the crown block assembly 14 and the travelling block assembly 18 are vertical and parallel, and that the fleet angle of the line 42 with respect to all of the travelling block sheaves and all of the associated crown block sheaves is equal to zero.

In this embodiment the travelling block sheaves in each pair define planes that are separated by a distance S. As shown in FIG. 3*a*, the distance S and the pitch diameter $PD_{TB}$ of the inner travelling block sheave TB2A define two adjacent sides of a right triangle, and the pitch diameter $PD_T$ of the transfer sheave TA defines the hypotenuse of the triangle. $PD_T$ is preferably selected to satisfy the Pythagorean relationship $(PD_T)^2=(PD_{TB})^2+S^2$. By way of example, the following dimensions can be used:

S=6.375 inch;

$PD_{TB}$=39.25 inch;

$PD_T$=39.764 inch.

As used herein, the term "pitch diameter" means the diameter defined by the center of the line when wrapped 180° around a sheave, not the overall flange, nor the tread, diameter of the sheave.

Figure 3B:
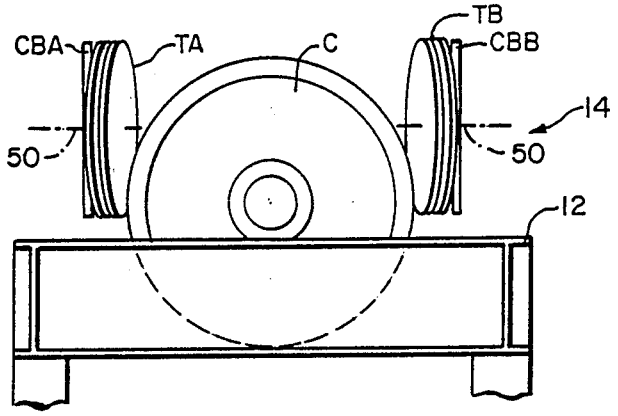
Figure 3C:
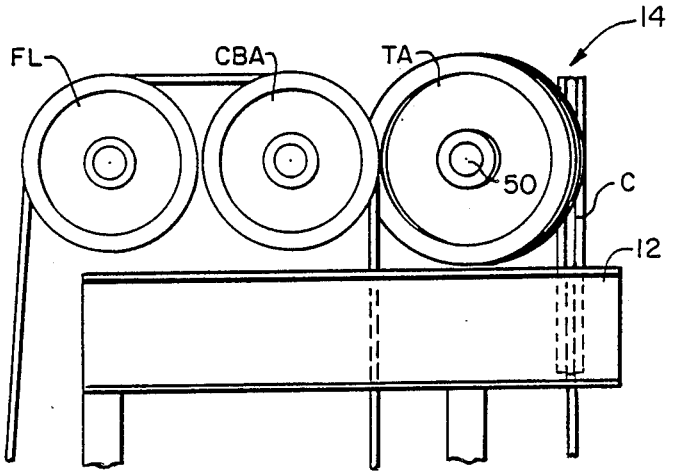

Another important advantage of the embodiment of FIGS. 3*a*–3*c* is that the centerline of the drilling machine is not obstructed by the crown block assembly 14, and various tools centered on the drilling axis can be passed through the crown block assembly 14 without obstruction by any of the components of the crown block assembly 14.

FIGS. 4*a*–*c* and 7 relate to a second preferred embodiment of the crown block assembly 14' and the travelling block assembly 18' of this invention. This embodiment includes eight sections of the line 42 extending between the crown block assembly 14' and the travelling block assembly 18'. In this embodiment the travelling block assembly 18' includes two pairs of travelling block sheaves TB1A', TB2A'; TB1B', TB2B' (FIG. 1*a*). The travelling block sheaves within each pair are mounted to rotate about a common axis 48, and the two axes 48 are canted with respect to another as shown in FIGS. 1*a* and 4*a*. In these figures dashed lines are used to indicate the planes of the travelling block sheaves.

The crown block assembly 14' includes a fast line sheave FL', a dead line sheave DL', a crossover sheave C', and four transfer sheaves T1A', T2A', T1B', T2B'. These transfer sheaves are grouped in pairs, and the transfer sheaves in each pair are mounted about a common axis 50. Furthermore, the axes 50 of all four of the transfer sheaves are coincident with one another, as shown in FIGS. 4*a* and 4*b*. The line 42 is reeved as shown in FIG. 7B.

The pitch diameters of the sheaves are carefully chosen to insure a zero fleet angle. In particular, the pitch diameter $PD_{TB'}$ of the travelling block sheaves is $39\frac{1}{4}$ inches, the pitch diameter $PD_{T2'}$ of the transfer sheaves T2A', T2B' is 39.764 inches, and the pitch diameter $PD_{T1'}$ of the transfer sheaves T1A', T1B' is $37\frac{3}{4}$ inches. In this embodiment the separation S' between the planes defined by adjacent travelling block sheaves is equal to 6-3/16 inches. The pitch diameters preferably satisfy the following relationship:

$$(PD_{T2'})^2=(PD_{TB'})^2+(S')^2.$$

Thus, the pitch diameter of the travelling block sheaves is greater than that of the transfer sheaves T1A', T1B', yet less than that of the transfer sheaves T2A', T2B'. By selecting pitch diameters appropriately as described above it can be insured that the eight sections of the line 42 extending between the crown block assembly 14' and the travelling block assembly 18' are all parallel to one another and vertical. In this way, it is insured that the fleet angles of all of these sections of the line 42 are zero. As before, the reference numeral 46 is used to designate those vertical segments of the line 42 extending between the crown block assembly 14' and the travelling block assembly 18'.

Figure 5A:
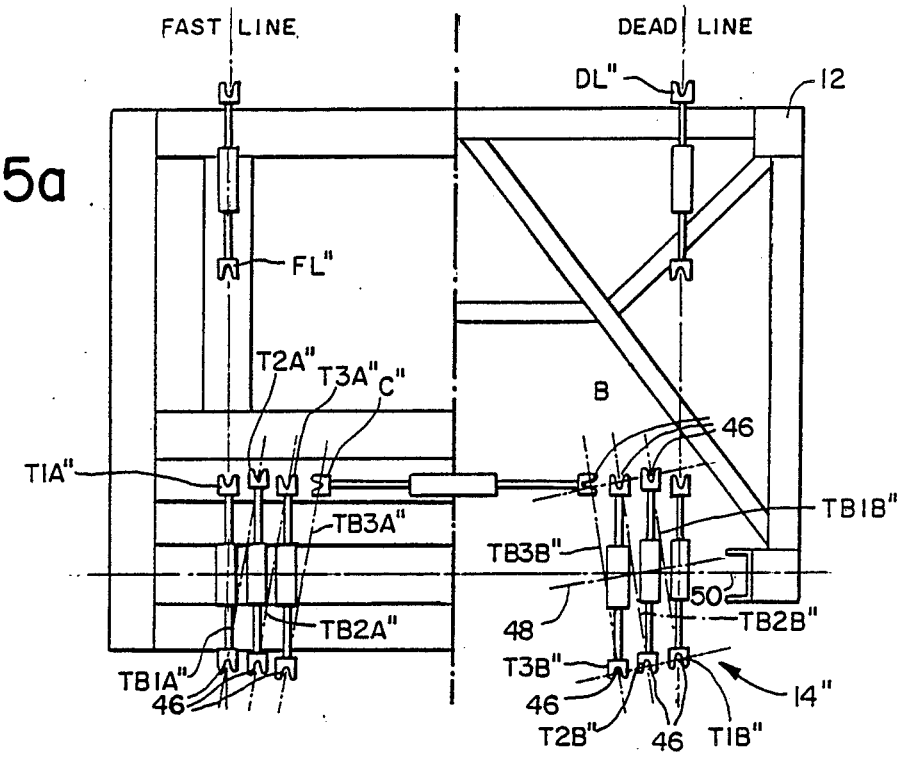
FIGS. 5*a*, *b* and *c* are plan, front elevation, and side elevation views, respectively, of a crown block assembly according to a third preferred embodiment of this invention.
Figure 5B:
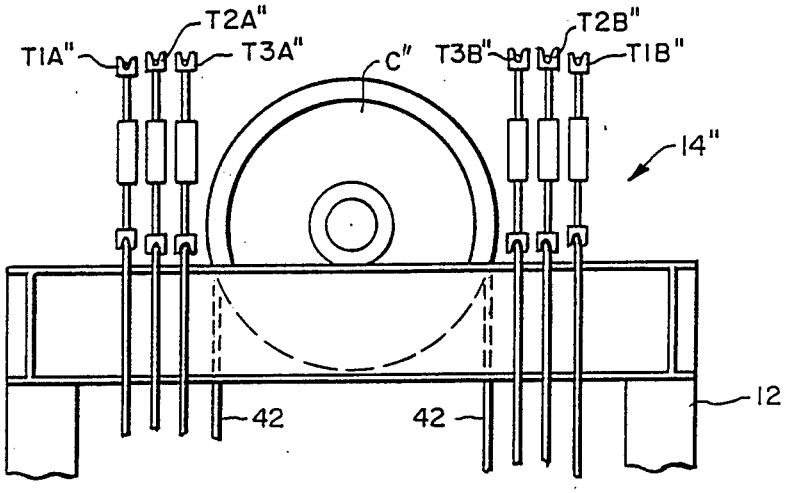
Figure 5C:
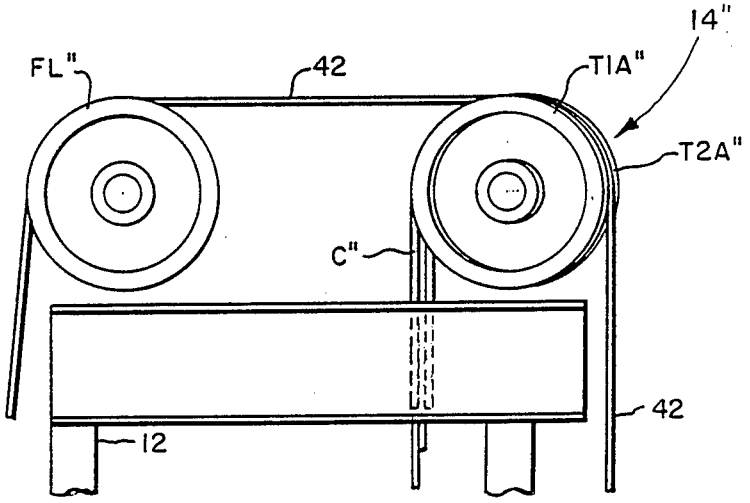

FIGS. 5*a*–*c* and 8 relate to a third preferred embodiment of the crown block assembly 14'' and the travelling block assembly 18'' of this invention. As best shown in FIG. 5*a* the travelling block assembly 18'' includes two sets of travelling block sheaves, each set including three parallel sheaves. The three travelling block sheaves TB1A'', TB2A'', TB3A'' are all mounted to rotate about a third shaft 48 and the remaining travelling block sheaves TB3B'', TB2B'', TB1B'' are all mounted to rotate about a second shaft 48. The axes of these two shafts define an obtuse angle therebetween. Dashed lines are used in FIG. 5*a* to show the planes of the travelling block sheaves.

Figure 8:
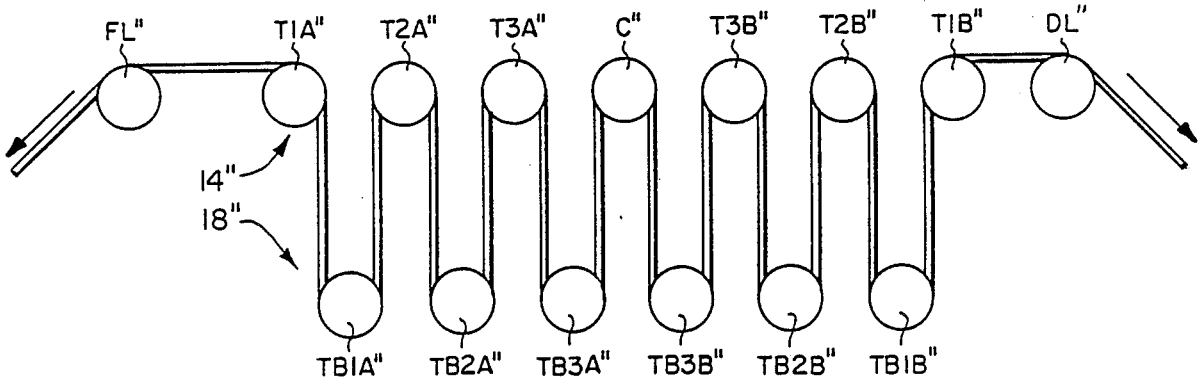

The crown block assembly 14'' includes a fast line sheave FL'', a dead line sheave DL'', a crossover sheave C'', and six transfer sheaves T1A'', T2A'', T3A''; T1B'', T2B'', and T3B''. All six of the transfer sheaves are mounted parallel to one another. The two outer transfer sheaves in each set T1A'', T2A''; T1B'', T2B'' are mounted to rotate about the same shaft axis 50, while the inboard transfer sheaves T3A'', T3B'', are laterally offset with respect to the remaining transfer sheaves. The line 42 is reeved as shown in FIG. 8. The lateral offset between the axes of the transfer sheaves and transfer sheave pitch diameters are selected to insure that the 12 sections of the line 42 extending between the crown block assembly 14'' and the travelling block assembly 18'' are all parallel and vertical. In this way, the fleet angle of all of these 12 line segments is maintained at zero.

Reference symbol X indicates an axis that passes through the rear vertical lines, and reference symbol Z indicates an axis that passes through the front vertical lines. Axes X, Z and 48 are all parallel.

A wide variety of structures can be used to provide the lateral offset described above for the transfer sheaves T3A'', T3B''. A first approach is shown in FIGS. 9 and 9*a* in which the transfer sheaves T2A'' and T3A'' are mounted on a one-piece offset shaft 50. This offset shaft 50 defines a first circular section 52 which receives the transfer sheave T2A'', and a second circular section 54 which receives the transfer sheave T3A''. The two sections 52, 54 are joined by a center section 56. Respective bearing caps 58 are provided for the center section 56 and the first and second sections 52, 54.

A second mounting approach is shown in FIGS. 10 and 10*a*, in which the transfer sheaves T2A'', T3A'' are mounted on separate offset pins 60*a*, 60*b*. The pin 60*a* is mounted between outer and center supports 62*a*, 62*b*, and the pin 60*b* is mounted between middle and inner supports 62*b*, 62*c*. As shown in FIG. 10*a* the pins 60*a*, 60*b* are offset sufficiently so as not to overlap and to allow individual ones of the pins 60*a*, 60*b* to be separately removed.

FIGS. 11 and 11*a* relate to a third mounting arrangement in which laterally offset abutting pins 64*a*, 64*b* are mounted in place in bearing caps 66. This mounting arrangement utilizes two separate pins to accomplish the same result as the one piece offset shaft 50 of FIG. 9.

From the foregoing description it should be apparent that the reeving arrangement of the present invention provides a fleet angle which is substantially zero between the drawworks and the crown block assembly, which is exactly zero between the crown block assembly and the travelling block assembly, and which is exactly zero between the crown block assembly and the dead line anchor. This reduces wear on the line, and allows the top head drive assembly to be raised to a point immediately adjacent the crown block assembly in the mast without exceeding allowable fleet angles. For this reason, the height of the mast can be reduced, thereby reducing the height, weight and windage of the drilling machine. All of this is accomplished while providing an open center to the crown block assembly which allows tools, logging lines, motion or wave compensators, and the like to be passed through the top of the mast along with drilling axis without interference from the crown block assembly. Furthermore, the embodiments of FIGS. 4*a* and 5*a* eliminate all reverse curves of the line. Because the fleet angle is kept equal to zero between sheaves and substantially equal to zero between the drawworks drum and the fast line sheave, the present invention allows the use of more flexible lines and therefore smaller sheaves.

Of course, it should be understood that a wide range of changes and modifications can be made to the preferred embodiments described above. In the foregoing description the term "vertical" has been used to clarify relationships assuming the mast to be vertical. Alternately, the mast may be tilted by a selected tilt angle from the vertical and all of the line sections between the crown block assembly and the travelling block assembly will then be tilted at the same tilt angle from the vertical. In addition, the various features described above with respect to sheave placement and sizing in the crown block assembly can also be applied to the travelling block assembly. It is therefore intended that the foregoing detailed description be regarded as illustrative rather than limiting, and that it be understood that it is the following claims, including all equivalents, which are intended to define the scope of this invention.

We claim:

1. In an earth drilling machine of the type having a mast including a mast base; a crown block assembly mounted on the mast and comprising a fast line sheave; a travelling block assembly movable along the mast, and a drawworks assembly comprising a drawworks drum having a drum rotation axis, the improvement comprising:

means for mounting the drawworks assembly adjacent the mast substantially no higher than the mast base such that the drawworks drum is substantially no higher than the mast base and the drum rotation axis is parallel to a fast line plane passing through the fast line sheave; and a line reeved from the drawworks drum to the fast line sheave and between the crown block assembly and the travelling block assembly, said line remaining within two line diameters of said fast line plane as the line passes between the drum and the fast line sheave throughout the complete range of rotation of the drawworks drum, thereby ensuring that the fleet angle of the line at the fast line sheave is substantially equal to zero;

wherein the complete range of rotation of the drum produces a plurality of layers of the line on the drum, and wherein a central one of the layers is aligned with the fast line plane.

2. The invention of claim 1 wherein the drum rotation axis is angled from a horizontal plane by a first angle, wherein the line from the fast line sheave initially engages the drum at a contact point, and wherein the first angle is selected to ensure that a plane containing the drum rotation axis and the contact point is perpendicular to the fast line plane.

3. The invention of claim 1 wherein the drilling machine comprises a dead line sheave and a dead line anchor, wherein the line that extends between the dead line anchor and the dead line sheave comprises a dead line, and wherein the dead line anchor and the dead line sheave are all in the same plane.

4. The invention of claim 3 wherein the plane containing the dead line, the deadline anchor, and the dead line sheave is parallel to the fast line plane.

5. The invention of claim 3 wherein the dead line anchor is positioned on the same side of the crown block assembly as the drawworks assembly.

6. The invention of claim 1 wherein the line deviates from the fast line plane by no more than one diameter throughout the complete range of rotation of the drum.

7. The invention of claim 6 wherein the drawworks assembly is mounted below the mast base such that the drawworks drum is below the mast base.

8. The invention of claim 7 wherein the drawworks assembly is mounted at ground level.

9. The invention of claim 1 wherein the drawworks assembly is mounted below the mast base such that the drawworks drum is below the mast base.

10. In an earth drilling machine of the type comprising a mast, a crown block assembly mounted on the mast, and a travelling block assembly mounted to move along the mast, wherein the travelling block assembly comprises at least first, second, third and fourth travelling block sheaves, the improvement comprising:

first and second crown block sheaves, included in the crown block assembly;

first and second transfer sheaves, included in the crown block assembly;

a crossover sheave, included in the crown block assembly; and a line reeved from the first crown block sheave, around the first travelling block sheave, around the first transfer sheave, around the second travelling block sheave, around the crossover sheave, around the third travelling block sheave, around the second transfer sheave, around the fourth travelling block sleave, to the second crown block sheave;

said transfer sheaves and said travelling block sheaves mounted to rotate about respective axes and said transfer sheave axes being canted with respect to said travelling block sheave axes;

said transfer sheaves and said travelling block sheaves defining respective pitch diameters and said transfer sheave pitch diameters differing from the travelling block sheave pitch diameters by an amount selected to ensure that the line defines a fleet angle of zero with respect to both the transfer sheaves and the travelling block sheaves;

said crown block sheaves and crossover sheave dimensioned and positioned to ensure that the line defines a fleet angle of zero with respect to both the crown block sheaves and the crossover sheave.

11. The invention of claim 10 wherein the transfer sheave pitch diameters are greater than the travelling block sheave pitch diameters.

12. The invention of claim 10 wherein the crown block assembly comprises a fast line sheave and wherein the invention further comprises:

a drawworks assembly comprising a drawworks drum having a drum rotation axis;

said drawworks assembly mounted adjacent the mast such that the drum rotation axis is parallel to a fast line plane passing through the fast line sheave;

said line reeved from the drawworks drum to the fast line sheave and remaining substantially within said fast line plane as the line passes between the drum and the fast line sheave throughout the complete range of rotation of the drawworks drum, thereby ensuring that the fleet angle of the line at the fast line sheave is substantially equal to zero.

13. In an earth drilling machine of the type comprising a mast, a crown block assembly mounted on the mast, and a travelling block assembly mounted to move along the mast, wherein the travelling block assembly comprises at least first, second, third and fourth travelling block sheaves, the improvement comprising:

first and second transfer sheaves included in the crown block assembly; and a line reeved between the crown block assembly and the travelling block assembly, said line passing from the first travelling block sheave around the first transfer sheave to the second travelling block sheave, and from the third travelling block sheave around the second transfer sheaved to the fourth travelling block sheave;

said transfer sheaves and said travelling block sheaves mounted to rotate about respective axes and said transfer sheave axes being canted with respect to said travelling block sheave axes;

said transfer sheaves and said travelling block sheaves defining respective pitch diameters and said transfer sheave pitch diameters differing from said travelling block sheave pitch diameters by an amount selected to ensure that the line defines a fleet angle of zero with respect to both the transfer sheaves and the travelling block sheaves;

said crown block assembly comprising at least one additional sheave positioned and dimensioned to ensure that the line defines a fleet angle of zero with respect to each of said additional sheaves.

14. The invention of claim 13 wherein the crown block assembly comprises a fast line sheave and wherein the invention further comprises:

a drawworks assembly comprising a drawworks drum having a drum rotation axis;

said drawworks assembly mounted adjacent the mast such that the drum rotation axis is parallel to a fast line plane passing through the fast line sheave;

said line reeved from the drawworks drum to the fast line sheave and remaining substantially within said fast line plane as the line passes between the drum and the fast line sheave throughout the complete range of rotation of the drawworks drum, thereby ensuring that the fleet angle of the line at the fast line sheave is substantially equal to zero.

15. In an earth drilling machine of the type comprising a mast, a crown block assembly mounted on the mast, and a travelling block assembly mounted to move along the mast, wherein the travelling block assembly comprises at least first, second, third and fourth travelling block sheaves, the improvement comprising:

first and second pairs of transfer sheaves included in the crown block assembly, each of said pairs comprising a first and a second transfer sheave said first transfer sheaves each defining a pitch diameter smaller than that of each of said second transfer sheaves, each of the transfer sheaves in each pair mounted to rotate on a common transfer sheave axis;

a line reeved between the crown block assembly and the travelling block assembly, said line passing from the first transfer sheave of the first pair around the first travelling block sheave, around the second transfer sheave of the first pair, to the second travelling block sheave, and from the third travelling block sheave around the second transfer sheave of the second pair, around the fourth travelling block sheave to the first transfer sheave of the second pair;

said travelling block sheaves being grouped in first and second sets, each having a common travelling block sheave axis and said travelling block sheave axes being canted with respect to the corresponding transfer sheave axis;

said travelling block sheaves defining a pitch diameter differing from the first and second transfer sheave pitch diameters;

said pitch diameters selected to ensure that the line defines a zero fleet angle with respect to both the transfer sheaves and the travelling block sheaves;

said crown block assembly comprising at least one additional sheave positioned and dimensioned to ensure that the line defines a zero fleet angle with respect to each of said additional sheaves.

16. The invention of claim 15 wherein the travelling block sheave pitch diameter is greater than said first transfer sheave pitch diameter and less than said second transfer sheave pitch diameter.

17. The invention of claim 15 wherein the crown block assembly comprises a fast line sheave and wherein the invention further comprises:

a drawworks assembly comprising a drawworks drum having a drum rotation axis;

said drawworks assembly mounted adjacent the mast such that the drum rotation axis is parallel to a fast line plane passing through the fast line sheave;

said line reeved from the drawworks drum to the fast line sheave and remaining substantially within said fast line plane as the line passes between the drum and the fast line sheave throughout the complete range of rotation of the drawworks drum, thereby ensuring that the fleet angle of the line at the fast line sheave is substantially equal to zero.

18. In an earth drilling machine of the type comprising a mast, a crown block assembly mounted on the mast, and a travelling block assembly mounted to move along the mast, wherein the travelling block assembly comprises two sets of travelling block sheaves, each set having at least first and second travelling block sheaves, the improvement comprising:

first and second sets of transfer sheaves included in the crown block assembly, each of said sets comprising at least first and second transfer sheaves;

the first and second sheaves in each set of either the transfer sheaves or the travelling block sheaves mounted to rotate about parallel, laterally offset axes;

a line reeved between the crown block assembly and the travelling block assembly, said line passing from the first transfer sheave of the first pair around the first travelling block sheave, around the second transfer sheave of the first pair, to the second travelling block sheave; and from the third travelling block sheave around the second transfer sheave of the second pair, around the fourth travelling block sheave to the first transfer sheave of the second pair;

said travelling block sheaves being grouped in first and second sets, each having a common travelling block sheave axis and said travelling block sheave axes being canted with respect to the corresponding transfer sheave axes;

said transfer sheaves dimensioned and said offset axes positioned to ensure that the line defines a zero fleet angle with respect to both the transfer sheaves and the travelling block sheaves;

said crown block assembly comprising at least one additional sheave positioned and dimensioned to ensure that the line defines a zero fleet angle with respect to each of said additional sheaves.

19. The invention of claim 18 wherein said transfer sheaves and said travelling block sheaves each define a respective pitch diameter, and wherein the transfer sheave pitch diameter is larger than the travelling block sheave pitch diameter.

20. The invention of claim 18 wherein the first and second transfer sheaves in each set are mounted to rotate about said parallel, laterally offset axes.

21. The invention of claim 18 wherein the crown block assembly additionally comprises first and second crown block sheaves, wherein each of the sets of transfer sheaves comprises an additional transfer sheave mounted coaxially with an adjacent one of the other transfer sheaves of the set, wherein the pitch diameter of the additional transfer sheaves is less than the pitch diameters of the other transfer sheaves, wherein each of the sets of travelling block sheaves comprises an additional travelling block sheave, wherein the line is reeved from the first crown block sheave to the additional transfer sheave of the first set, around the additional travelling block sheave of the first set to the first transfer sheave of the first set; wherein the line is also reeved from the first transfer sheave of the second set, around the additional travelling block sheave of the second set, to the additional transfer sheave of the second set, to the second crown block sheave; wherein the additional transfer sheaves are dimensioned and positioned to ensure that the line defines a zero fleet angle with respect to both the additional transfer sheaves and the additional travelling block sheaves.

22. The invention of claim 18 wherein the first and second transfer sheaves in each set rotate about respective shafts and wherein the crown block assembly comprises means for mounting the shafts in abutting, parallel, laterally offset relation to one another.

23. The invention of claim 18 wherein the first and second transfer sheaves in each set rotate about respective segments of a single shaft, wherein the segments are parallel and laterally offset with respect to one another, and wherein the crown block assembly comprises means for mounting the shaft in position.

24. The invention of claim 18 wherein the first and second sheaves in each set rotate about respective shafts, and wherein the crown block assembly comprises means for mounting the shafts in parallel, non-overlapping, offset relation to one another.

25. The invention of claim 18 wherein the crown block assembly comprises a fast line sheave and wherein the invention further comprises:

a drawworks assembly comprising a drawworks drum having a drum rotation axis;

said drawworks assembly mounted adjacent the mast such that the drum rotation axis is parallel to a fast line plane passing through the fast line sheave;

said line reeved from the drawworks drum to the fast line sheave and remaining substantially within said fast line plane as the line passes between the drum and the fast line sheave throughout the complete range of rotation of the drawworks drum, thereby ensuring that the fleet angle of the line at the fast line sheave is substantially equal to zero.

* * * * *